United States Patent [19]

Richardson

[11] Patent Number: 4,527,509

[45] Date of Patent: Jul. 9, 1985

[54] DIELECTRIC FILM PROCESSOR

[75] Inventor: John J. Richardson, Wayne, N.J.

[73] Assignee: GAF Corporation, Wayne, N.J.

[21] Appl. No.: 608,676

[22] Filed: May 10, 1984

[51] Int. Cl.[3] ..... G03G 15/06

[52] U.S. Cl. ..... 418/650; 118/60; 118/63; 118/65; 118/660; 118/662

[58] Field of Search ..... 118/647, 662, 650, 660, 118/60, 63, 65

[56] References Cited

U.S. PATENT DOCUMENTS

| | | | |
|---|---|---|---|
| 3,359,945 | 12/1967 | Hastings et al. | 118/662 |
| 3,472,657 | 10/1969 | Mayer et al. | 118/647 |
| 3,547,076 | 12/1970 | Saklikar | 118/662 |
| 3,636,925 | 1/1972 | Reuter et al. | 118/647 |

*Primary Examiner*—Bernard D. Pianalto

*Attorney, Agent, or Firm*—Joshua J. Ward; Marilyn J. Maue

[57] ABSTRACT

The processor is designed to develop imaged film in sheet or roll form, using a leaderless system employing edge guiding of the film. In this design the exposed film is transported in such a manner that no physical contact is made with the image area by any part of the processor until the image has been fused onto the film. The toned and fused image is permanent and smudge proof.

The processor, as it is designed, has the capability of using different toners, adjusting film speed to meet toning and fusing requirements, changing fusing temperature depending on the toner at a given film speed, and adjusting the action of the air knife to improve its doctoring of the toned image prior to fusing. The processor is compact and lightweight, and the design gives due consideration to the health and safety of the operator.

An important feature is the toner tray which has multiple inlets for toner with a central discharge to protect the film that is being processed from scratching.

2 Claims, 8 Drawing Figures

FIG. 1
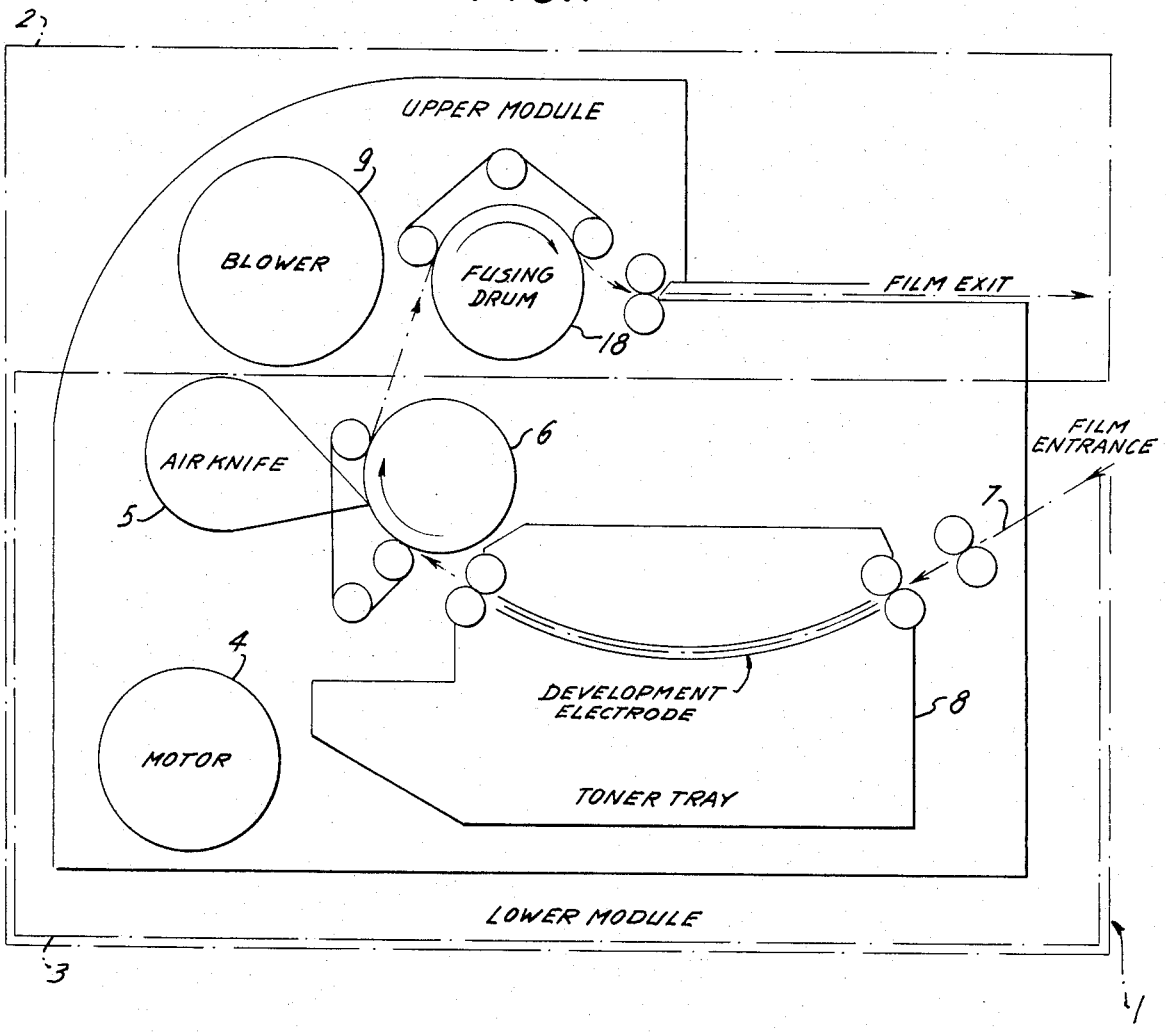
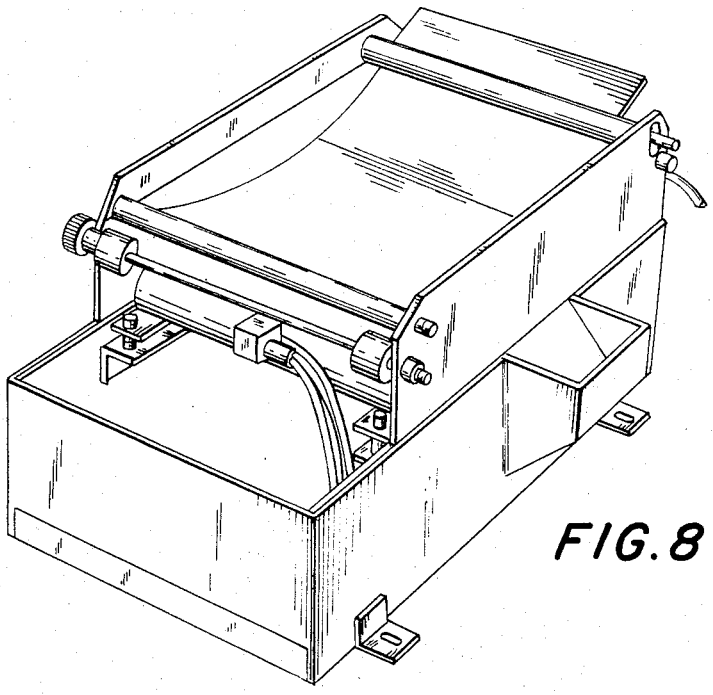
FIG. 8

FIG. 2
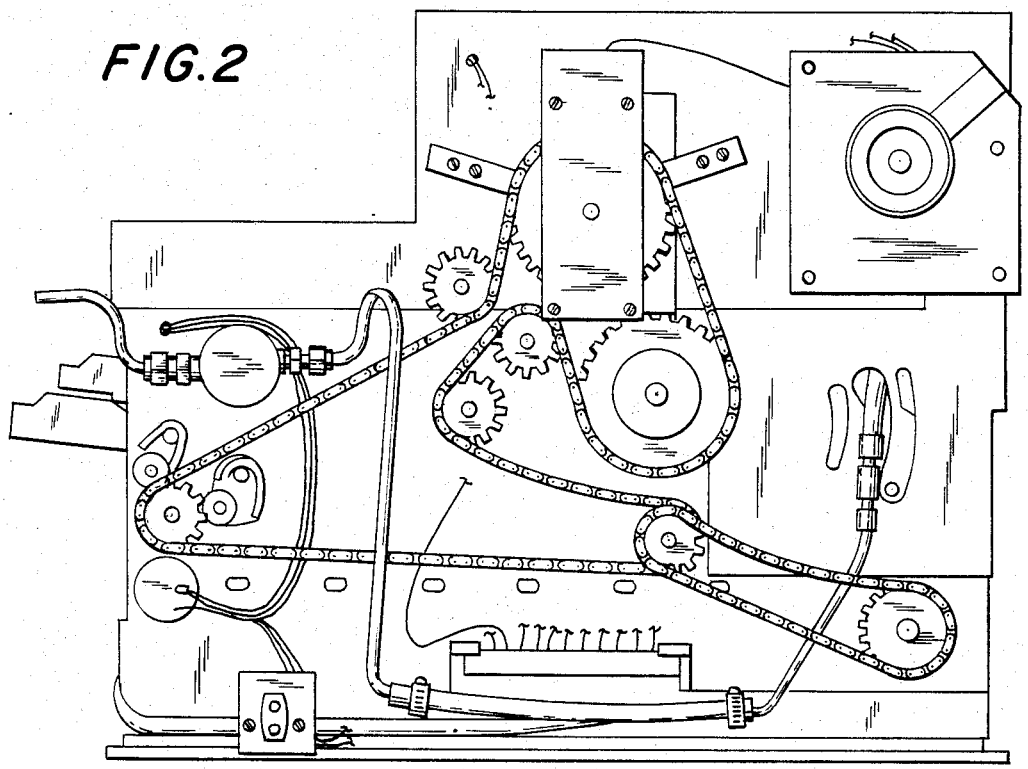
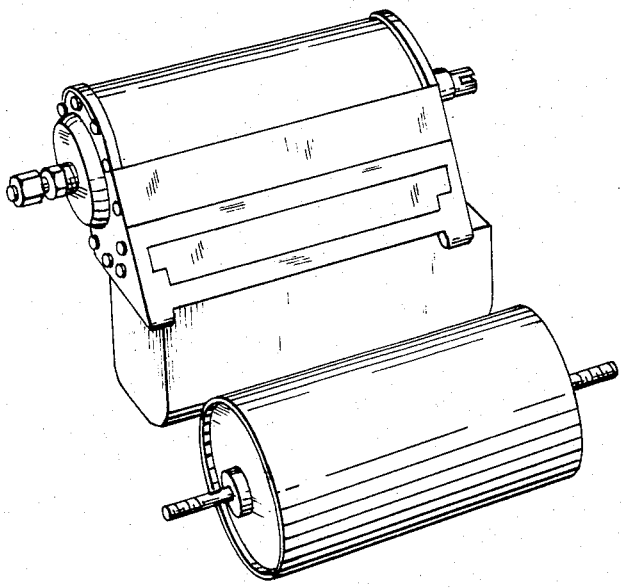
FIG. 4
FIG. 5
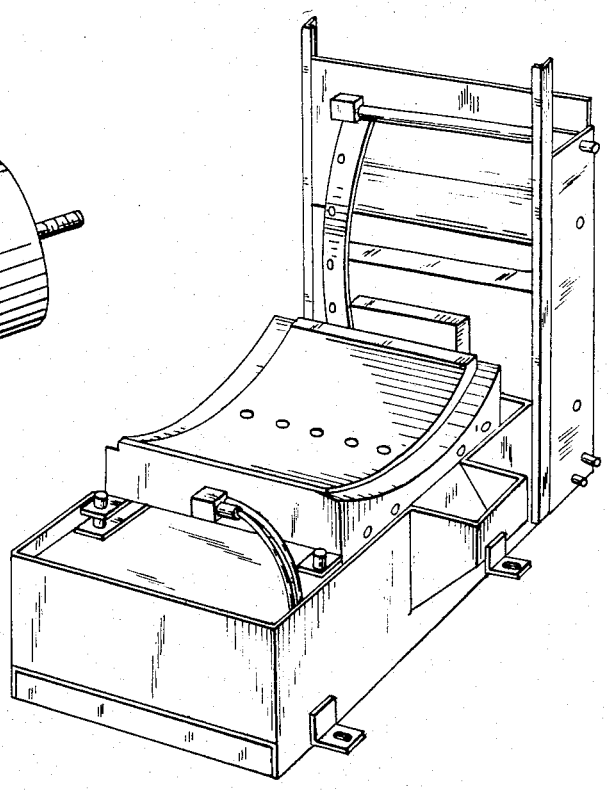

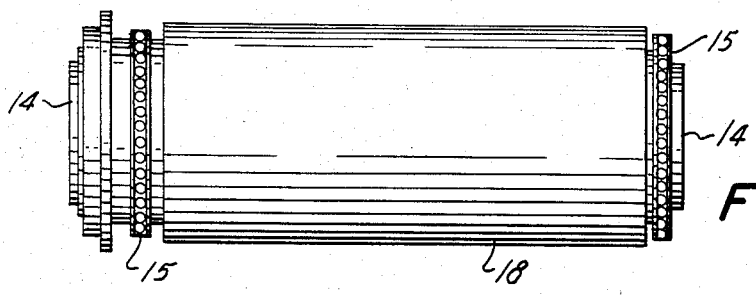
FIG.3
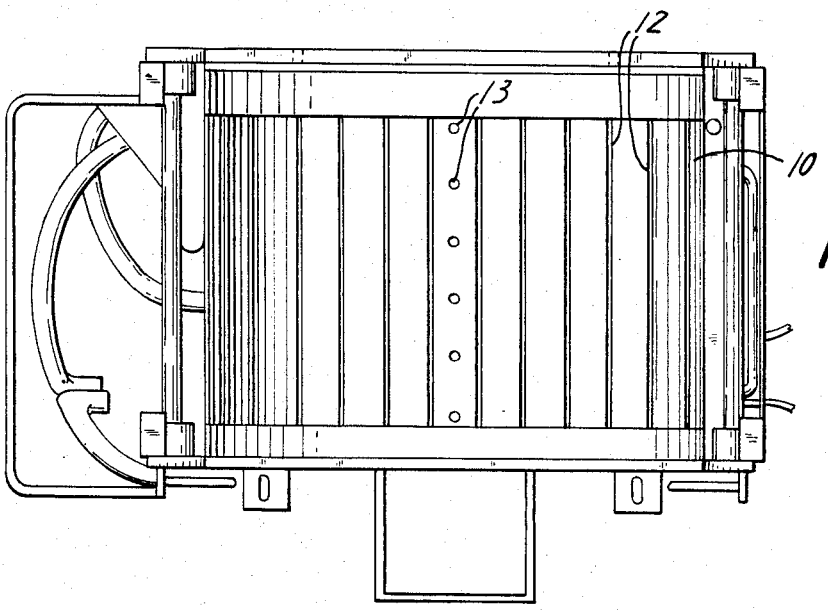
FIG.6
FIG.7
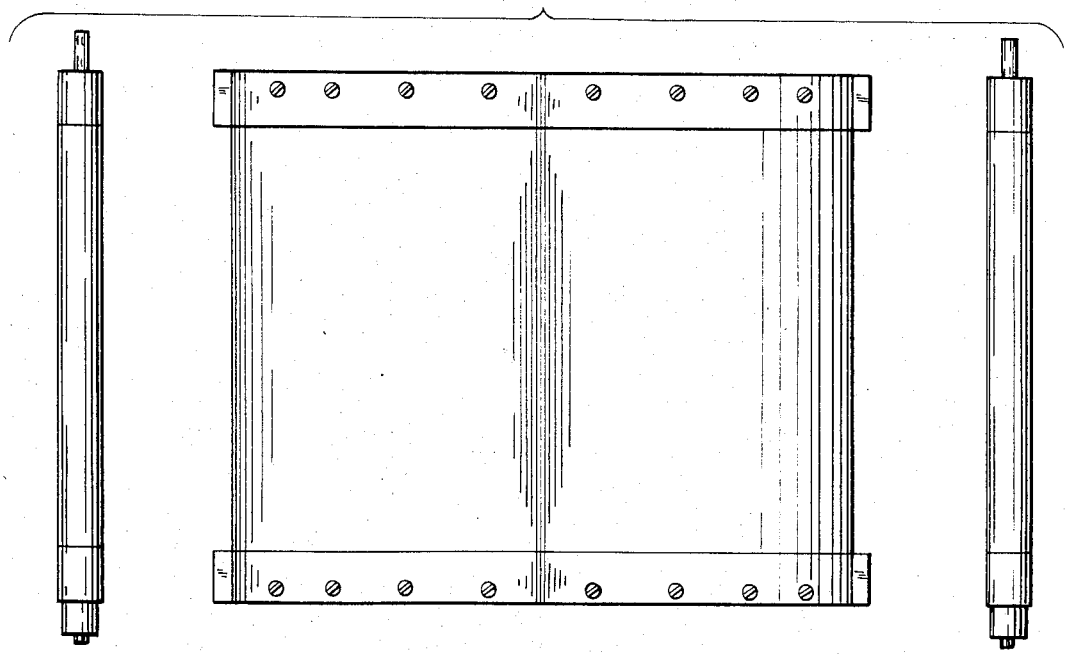

DIELECTRIC FILM PROCESSOR

BACKGROUND OF THE INVENTION

An important step in the development of a film processor is determining the film characteristics after exposure and the type of toner to be used, i.e. liquid or power.

A large number of toner device designs for developing latent, electrostatic images exist; a few of these being disclosed in U.S. Pat. Nos. 3,202,526; 3,203,395; 3,627,410 and 3,651,782.

The basic principle involved in many toner apparatus is to place the electrostatically-imaged dielectric sheet in proximity to a developing electrode surface. Simultaneously, toner fluid is circulated across the dielectric sheet, to cause the pigment particles of the fluid to adhere to the electrostatically-charged image areas. Thereafter, the dielectric sheet is dried, to permit a binder agent such as a resin to cause the pigment to permanently adhere to the dielectric sheet.

Significant problems have existed in the prior art, which have restricted the utility of fluid toner devices as a means of developing dielectric sheets having latent electrostatic images. First, during the development process, the electrostatic sheet is desirably precisely and uniformly spaced from the developing electrode, yet with room for toner solution to circulate between the dielectric sheet and the developing electrode surface. Generally, the prior art has not provided a satisfactory solution for accomplishing this.

Also, the toner solution in use is quickly depleted of pigment particles. If the spent toner solution is permitted to continue to circulate in the presence of the electrostatic image on the dielectric sheet, it will begin to wash away pigment particles which have already been deposited on the electrostatic image, resulting in a poor, scratched, or smeared image on the dielectric sheet.

In accordance with this invention, the above problems are effectively eliminated resulting in toner a apparatus which can reliably provide uniformly-toned electrostatic images.

SUMMARY OF THE INVENTION

The film processor is designed in two sections, the toning section and the fusing section. The toning section or lower module contains the following: the toner tray with a development electrode, the air knife and its backing drum, and the system drive motor. The fusing section or upper module houses the following: the film sensor, the exhaust blowers, and the fusing drum. The power supply for the processor is housed in a rack mounted-chassis and is connected to the processor with two cables.

The film path designed, such that the processor would be compact. The film, as it enters the processor, has the exposed side down, and is edge guided throughout its path. The edge of the film does not have a dielectric layer on it, thereby leaving the conductive layer exposed. This conductive layer is grounded to the processor at all times by contact with the metal drive rollers and metal guides.

The toner tray assembly is completely removable from the processor for ease of adjustment and for ease of cleaning. The toner tray assembly includes a development electrode. This electrode is electrically isolated from the toner tray assembly and therefore permits the application of a voltage. By applying a voltage, the electrostatic field configuration produced by the image is charged. In addition, the development electrode intensifies the field between the conductive layer and the electrode itself. The field strength generated by the development electrode depends on its distance from the conductive layer; the closer the electrode, the higher the field strength. The electrode can have either a positive or negative potential, depending on the toner being used. The development electrode is also adjustable so that its distance from the film can be varied from 0.050 inch to 0.100 inch.

The toner is pumped through the development electrode manifold and exits on the surface of the electrode, entering by way of the toner flow channel.

If, when the film reaches the egress side, the toner flow into the channel does not exert enough pressure the film will buckle and scratch. To overcome this problem a new development electrode/toner manifold was designed. The design has six toner input slots on the entrance side, and six more toner input slots on the egress side. All the slots are equally spaced along the surface of the development electrode/toner manifold thereby exerting an upward pressure along the route of the film. In tests of the system, no scratching of the film occurred.

The electrode/toner manifold has discharge slots centrally located between the input and egress sides. If the dielectric film leaves the toning tray assembly with excess toner adhering to it, and the dielectric film is allowed to enter the fusing station in this condition, it is likely that the excess toner will be deposited where it is not wanted, thus decreasing the quality of the image. In addition, the excess toner will have to be vaporized in the fusing station and the time required to fuse the image will be increased. All of these undesirable effects can be minimized by removing the excess toner from the dielectric film immediately after it leaves the toning station, before it has a chance to dry naturally, and before it enters the fusing station. To accomplish this an adjustable air knife is employed. This is in keeping with the design that does not permit the exposed (charged) dielectric film surface to touch a solid surface until it leaves the fusing station. The only materials allowed to touch the exposed dielectric film surface are the toner itself and a controlled jet of air.

It is important that the mechanical effect of the air knife in removing excess toner predominates over its drying effect. Otherwise, image quality will be affected adversely. The volatility of the solvent and the total air flow may be varied to satisfy this criterion.

The fusing drum rotates at a speed equal to the film speed so that the film is stationary with respect to the drum when it contacts the drum. The drum is aluminum that is black anodized to increase its absorptivity and emissivity.

The power supply is 115 VAC, 15 amps. The AC voltage input is controlled by a double pole on/off circuit breaker. An AC convenience outlet is on the front panel to supply power for a separate high voltage power supply for the development electrode.

A chain is used as the system drive. Power is supplied by the motor using one sprocket to the main drive. The main drive is provided by one continuous chain. Gear pickoffs are used to transmit power to the toner tray assembly and to the edge guide belts on the air knife backing drum.

Micro switch interlocks are used on the processor cover and on the terminal board cover on the power supply. Removal of any processor cover will turn off the system power. If the air temperature above the fusing drum exceeds 53° C., the air temperature sensor will open, which will cause the system power to be turned off. Exhaust blowers evacuate the toner fumes from the area of the processor during its operation.

The above processor is designed such that it can handle both roll and sheet film.

Further emobdiments incorporating the basic concept of this invention will be apparent to those skilled in the art.

The invention is further described with reference to the annexed drawings.

BRIEF DESCRIPTION OF THE DRAWINGS

FIG. 1 is a side view of the processor.

FIG. 2 is a side view of the drive system of the processor.

FIG. 3 is a front view of the fusing drum.

FIG. 4 is a prospective view of the air knife and backing drum.

FIG. 5 is a prospective view of the toner tray.

FIG. 6 is a top view of the development electrode/-manifold.

FIG. 7 is a top view of the backing shoe and film guides with idler rollers.

FIG. 8 is a prospective view of the toner tray looking from the film exit side.

DESCRIPTION OF THE PREFERRED EMBODIMENTS

Turning now to the drawings FIG. 1 shows the film processor 1 broken into its upper, 2, and lower, 3, module. Contained in the lower module 3 is motor 4 for driving the processor 1, air knife 5 working in conjunction with backing roll 6 removes excess toner that the film 7 picked up from the toner tray 8 as it passed through the tray. After the film 7 exits the lower module 3 it enters into upper module 2 where it comes into contact with the fusing drum 18 before its exit from the upper module 2 and the processor 1. Blower 9 located in upper module 2 is the exhaust system for removing any fumes that develop in the processor 1.

The toner tray 8 consists of two major parts; a backing plate 11 which is located above the path that film 7 travels and a electrode/manifold 10, located below where the film 7 travels. This electrode/manifold 10 consists of toner entrance slots 12 and toner drain holes 13 centrally located across the electrode/manifold 10 at its lowest portion. In operation, tone liquid is fed through slots 12 upon which the film 7 rides and said fluid then flows toward the drain holes 13. In this manner the film 7 never touches the manifold 10 and scratching is prevented. Backing plate 11 prevents the liquid toner from flowing out of the toner tray 8 into other portions of the processor 1. Because the manifold 10 is curved and flow of the toner is both from the entrance and exit of the manifold 10 at controlled intervals, the film 7, unlike in the past, gets complete protection from scratching either at its input or exit.

Once the film leaves the toner tray assembly 8 it moves into a position between air knife 5 and backing roll 6 where the air knife removes, without drying the film, 7 the excess toner. The use of the air knife procedure for removal of the excess toner as opposed to another method is preferred since this prevents the imaged film 7 from making contact with anything that may scratch said film 7. It should be remembered, however, that the air flow from air knife 5 should be convergent and laminar. After the excess toner is removed, the film 7 is acted upon by the fusing drum 18 which rotates at a speed equal to the film speed so that the film is stationary with respect to the drum 18 when it contacts the drum 18. The drum 18 is of aluminum that is black anodized to increase its absorptivity and emissivity. The drum 18 is mounted in two stainless steel hubs (14) which have the contact area with the drum 18 minimized to reduce heat conduction. This assembly is mounted into two stainless steel torque tube ball bearings 15. Inside each hub there are ceramic insulators (not shown) whose purpose is to reduce the heat absorbed by the stainless steel hubs 14. Through the drum 8, on its centerline, is a 500 W quartz infrared lamp (not shown) which is stationary with respect to the drum 18. A thermistor (not shown) is mounted on a sled which is in contact with the drum's outer surface to sense drum temperature. In addition there is a temperature sensor (not shown) above the drum to measure the ambient temperature. If the temperature should exceed 53° C., the sensor will automatically turn off the processor 1. The purpose of this sensor is to prevent overheating in the event that the temperature regulation system fails.

After the image is fused onto the film 7 by fuser drum 18, it exits the processor 1 to the atmosphere.

Any fumes that are contained with the processor 1 are removed by a blower or blowers 9 which are mounted in the upper module 2. The volume of air that can be removed is 20 cfm. The blowers 9 are ducted so that they can remove the fumes of the toner vehicle, Isopar (deodorized kerosense), which can be harmful. The ducting also permits removal of the fumes that exist in the area of the toner tray 8. These fumes are present by virtue of the relatively high vapor pressure of the Isopar. The fumes are also removed in the area of the air knife 5. These fumes are produced by the drying action of the air knife 5 on the film 7, which causes misting of the toner. The final area of concern is above the fusing drum 18, where again ducting is used to remove the Isopar fumes that are generated. The exhaust can be ducted away from the operator and the processor's environment to the outside atmosphere, where the concentration would be well below the tolerable limit.

The power supply with its various components, none of which are shown since they are all well known items of the trade, consist of a power requirement of 115 VAC, 15 amps. The AC voltage input is controlled by a double pole on/off circuit breaker manufactured by Hienaman. An AC convenience outlet is on the front panel to supply power for a separate high voltage power supply for the development electrode. The high voltage power supply, such as the Keithley Instruments Model 240A or the equivalent, when plugged into the processor power supply, is also controlled by the circuit breaker. Housed in the power supply is the motor speed controller. The controller is Model 911 manufactured by Bodine for use with their Model 531 motor. With this motor/controller combination the film processor is capable of film speeds from 3.0 inches per minute to 178.8 inches per minute.

A 0.250 inch pitch chain 15 is used as the system drive. Power is supplied by the Bodine motor 4 using one sprocket pass to the main drive. The main drive is provided by the one continuous chain 15. Gear pickoffs are used to transmit power to the toner tray assembly 8 and to the edge guide belts on the air knife 5 and backing drum 6.

It will be apparent to those skilled in the art that other embodiments as well as variations and modifications of the embodiments described herein are available that will fall within the scope and extent of this invention.

What is claimed is:

1. An improved dielectric film processor comprising a film entrance and exit means, film guide means located between said entrance and exit means, located between the the entrance and exit means and part of the film guide means is a toner supply and developing means, said toner supply and developing means has adjacent to both it and the exit means an air knife, backing roll means and fusing means for fusing an inage onto a film before it exits the processor wherein the improvement in said film processor is the toner supply and developing means has a concave manifold having toner fed slots from a top portion of the concave manifold to a bottom portion of the concave manifold with a toner exit hole located at the lower most portion of the concave manifold.

2. The processor described in claim 1 wherein the concaved manifold contains a development electrode.

* * * * *